United States Patent [19]

Liggett

[11] 4,235,346

[45] Nov. 25, 1980

[54] COLLAPSIBLE LIGHTWEIGHT SHIPPING CONTAINER

[76] Inventor: Joseph Liggett, 6 Riverview Ter., New York, N.Y. 10022

[21] Appl. No.: 77,053

[22] Filed: Sep. 19, 1979

[51] Int. Cl.[3] ..... B65D 7/24; B65D 7/42

[52] U.S. Cl. ..... 220/7; 220/72; 220/339; 220/62; 220/6; 229/30

[58] Field of Search ..... 220/6, 7, 62, 72, 339, 220/903; 229/30

[56] References Cited

U.S. PATENT DOCUMENTS

| | | | |
|---|---|---|---|
| 3,675,808 | 7/1972 | Brink | 220/7 |
| 4,010,865 | 3/1977 | Wilgus | 220/6 |
| 4,014,450 | 3/1977 | Girotti et al. | 220/72 X |
| 4,170,313 | 10/1979 | Caves et al. | 220/7 |

*Primary Examiner*—George T. Hall
*Attorney, Agent, or Firm*—Bertram Frank

[57] ABSTRACT

A lightweight collapsible shipping container is provided having a unitary molded construction in which a bottom panel is hingedly joined to four peripheral side panels and a top panel is hingedly joined to one of said side panels in a manner to provide an essentially co-planar and stackable association of panels when in knockdown condition, with edges of said side panels and top panel having interlocking means as the side panels are raised to positions perpendicular to the bottom panel and the top panel is lowered over the assembled side panels. In preferred embodiments of the invention, the side panels are vertically ribbed on at least one surface thereof to enhance the stacking strength; offsets may be formed in the top and bottom panels to provide an interlock between stacked container and/or to position articles within the container, such offsets preferably being formed in such manner as to not interfere with stacking of containers when in the knockdown condition with the several panels in a co-planar orientation. In other preferred embodiments interlocking means is also provided at the hinged junctures between adjacent panels to strengthen the same when in assembled orientation; the formation of such interlocking means being accomplished by shallow undercuts in mold parts or by movable inserts in mold parts permitting formation of deeper undercuts.

26 Claims, 13 Drawing Figures

28
27
28
26
28
26
17
10
16
24
25
15
24
25
20'
20'
12
12
20
14
11
14a
20
2
12
12
20'
20'
23
13
23
22
22
2
21

10
22
18
20
20
20'
14
23
21
13
19
11
12
14a

COLLAPSIBLE LIGHTWEIGHT SHIPPING CONTAINER

This invention relates to improved packing and shipping containers fashioned from lightweight foamed plastic material, and initially molded in a flat, knock-down configuration permitting foldable assembly to three-dimensional container configuration, wherein one or more novel structural features serve to enhance the durability in the stacking and packing of filled containers. In the preferred adaptation of these novel features upper and lower faces of the container in the extended or knock-down configuration are maintained free of protrusion on one surface, unmatched by depression on the upper surface, so that for shipping and storage prior to use aligned containers can be stacked to any height convenient for bulk handling.

BACKGROUND OF THE INVENTION

The packing and shipping container art is one of the most highly developed arts, and even the fabrication of such containers from moldable foamed plastics, such as expandable polystyrene foam and the like, has already received wide acceptance. It is significant to note, however, that the use of foamed plastics has leaned heavily toward container liners or complete containers which are encased in an outer, protective container; with only limited use of the foamed plastic as the sole packing and shipping container.

A search of the patent art concerning foamed plastic containers suitable for use as sole packing and shipping containers has brought to light the following U.S. patents as most closely related to the novel structures disclosed and claimed herein.

a. J. M. Harrison U.S. Pat. No. 3,156,371
b. R. O. Ragan et al U.S. Pat. No. 3,317,114
c. R. A. Bellamy U.S. Pat. No. 3,330,437
d. D. L. Brink U.S. Pat. No. 3,675,808
e. J. L. Wilgus U.S. Pat. No. 4,010,865

The Harrison container leaves much to be desired due to difficulty in handling the loosely joined panels of the knockdown configuration and the absence of joining means for the side panels prior to interengagement with the top.

The Ragan et al container inherently relates to a thin-walled structure, hardly suitable as a sole shipping container, and it is assembled by a heat sealing process which makes on site assembly of containers at the point of use impractical.

The Bellamy container is impractical as a sole shipping container because of its many external irregularities, and the structure disclosed does not permit flat stacking in extended configuration.

The Brink patent relates particularly to a fruit packing container in which the lid is completely removable to permit the open container to be used for the display and dispensing of fruit. The structure therefore does not lend itself to general purpose, sole shipping containers.

The Wilgus patent relates to a container in which foamed plastic panels are held together by an outer skin of tough abrasion-resistant material; and such a composite construction inherently adds to cost and construction problems as compared with a container which can be completely molded from foamed plastic material.

In addition to the above mentioned patent art, it should be noted that foamed plastic containers are available on the market in which the six walls forming a complete container are molded as a single blank in a manner to be stackable to any convenient height when in the extended knock-down configuration and in which the sidewalls interlock, as raised to the vertical position to permit arrangement of goods within a formed container which is further locked together by hinged closing of a lid panel integral with one of the sidewalls.

In order that the examiner may visualize this commercially available construction, and to provide a point of reference concerning improvements of the present invention, such commercially available container has been illustrated in FIGS. 1 and 2 of the drawing.

While this commercially available container is neat and practical as a sole shipping container, and reasonably strong and durable when sealed by tape or strapping in the conventional way, it presents problems in the bulk handling which shipping containers frequently encounter, in which several layers of containers may be loaded on a pallet and loaded pallets stacked several tiers high. In such practices, the lower containers on a loaded pallet and all containers on pallets having other pallets stacked above them must withstand a substantial compressive force; and it is in this area that the commercially available foamed plastic containers leave much to be desired.

THE INVENTION

The problems and shortcomings of containers shown in the patent art or available in commerce as above described are overcome by the improved structural features of the present invention which preserve the stackability of foamed plastic containers in extended knock-down configuration, while substantially reducing the chance of damage to assembled, filled containers when subjected to the compression loads of palleting and pallet tiering which characterize the storage and handling of shipping containers.

Regarded in certain of its broader aspects the improved packing and shipping container of the present invention comprises a unitary blank of molded, foamed plastic material in which a bottom panel is hingedly joined to four peripheral side panels and a top panel is hingedly joined to one of said side panels in a manner to provide an essentially co-planar and stackable association of panels when in knockdown configuration, with edges of said side panels and top panel having interlocking means as the side panels are raised to positions perpendicular to the bottom panel, and as the top panel is lowered over the assembled side panels, and in which compressive strength of the assembled containers is enhanced by at least one of the structural features that comprise enlarging surface area of the side panels to increase their strength, providing interlocking means at the hinged juncture between adjacent panels, and providing interlocking means on top and bottom container surfaces to assure accurate side wall alignment of stacked containers.

Each of these structural features used individually can substantially reduce the chance of damage to lower containers in the stacking and tiering practices above described, but the advantage is enhanced when two of these features, or all three of them are incorporated in the container. The number and selection of the features to be employed will vary with the type and weight of materials being packaged because the weight of contents is the primary factor in determining the compressive forces to be built up in stacked containers, the container itself being extremely light in weight.

Increasing the compression strength of the side walls is achieved by molding vertically oriented ribs or corrugations on at least one surface, or on both inner and outer surfaces of the side panels and molding aligning ribs in the edges of the top panel. The enhanced compression strength appears to be due in part to increase in the area of molded "skin" which is tougher than the interior of the molded plastic structure, and in part, when both inner and outer corrugations are employed, to an increase in the maximum transverse or thickness dimension in the wall panels. It is considered that such special fashioning of the side walls is the first step to take in increasing the compression strength of the containers.

The hinged joints provided by a relatively thin section of the molded, foamed plastic material represent a point of weakness, which becomes more serious as the weight of contents increases, due to the possibility of a sliding action causing the hinge to rupture. In commercially available containers such sliding action is minimized by molding an interfitting stepped configuration as the hinge is viewed in cross section. Such simple stepped configuration, however, provides little or no protection against sliding movements which can cause hinge rupture. The hinged joints can, of course, be strengthened by adhesively applying conventional reinforcing tapes externally of the hinge joints, but this involves time and expense, and detracts from the appearance of the containers.

In accordance with the present invention the hinge joints can be strengthened without any added tapes by providing detent means in one side of the hinge interlocking with projecting means on the other side fashioned by undercut forming means in the mold part. A small undercut can be made by a fixed mold part, with flexibility of the molded material permitting separation of the molded part from the mold. For making a more effective projection, entailing a deeper undercut, this can best be handled by employing appropriately positioned hingedly or slidably movable members in a composite mold construction.

The most advantageous interlock at the hinge joints are projections on side panel portions of hinge joints which are parallel to the planes of the side panels and enter vertically oriented depressions in the bottom panel or top panel hinge portion. These can be supplemented, however, by projections parallel to the respective planes of the top and bottom panels which enter horizontally disposed recesses in the hinge portions of the side panels.

Such interlocking means at the hinge portions can take the form of relatively small projections fitting into recesses of generally square or circular contour, or they can take the form of elongated flanges and grooves extending substantial distances along a hinge joint; and if the projections and depressions are only of the type first mentioned above, they may extend for substantially the full length of the hinge joint.

The third structural feature above mentioned, namely the provision of top and bottom interfitting means to maintain stacked alignment of containers, becomes of increasing importance as the weight of container contents increases, and as the container height increases with respect to a particular sized top and bottom. Containers stacked on a pallet are normally secured in place by strapping, and the frictional engagement between relatively flat containers, or containers with lightweight contents under the influence of the strapping will generally prevent any load shifting. With higher containers and/or heavier contents, however, the strapping alone may not prevent load shifting, and in such instances the container aligning means is of primary importance.

The container alighning means can take the form of several spaced projections on the bottom (or top) mating with correspongingly spaced recesses on the top (or bottom), or there can be a single large projection mating with a single large recess which extends throughout a major portion of the area of the container top and bottom.

When forming such projections and recesses, and in order to preserve both wall strength and stackability in the knockdown configuration, it is preferable that a projection on one surface of a top or bottom panel be aligned with a mating recess on the opposed surface of such panel.

The foamed plastic molding of containers lends itself to the fashioning of grooves in the inner side wall surfaces to position partitioning means in the assembled container, as well as to the formation of inner surface offsets in the top and bottom panels to position articles being packed in the container. Whenever possible, however, such inner surface irregularities should carry to the outer surfaces, and be comparable in the top and bottom walls so as to preserve the stackability of both the knockdown container and the assembled and filled container.

The foamed plastic molding of containers also lends itself to the custom embossing of symbols, text material etc. on appropriate inner and outer container surfaces. Such embossing, taking the form of a slight depression in the associated surface, would have no effect on stackability in either the knockdown or the assembled configuration.

Novel features of the present invention will be more fully understood from a consideration of the following description having reference to the accompanying drawing in which the coacting parts are identified by suitable reference characters in the several views, and in which:

FIG. 3 is a perspective view of a container illustrating improvements of the present invention.

Figure 4:
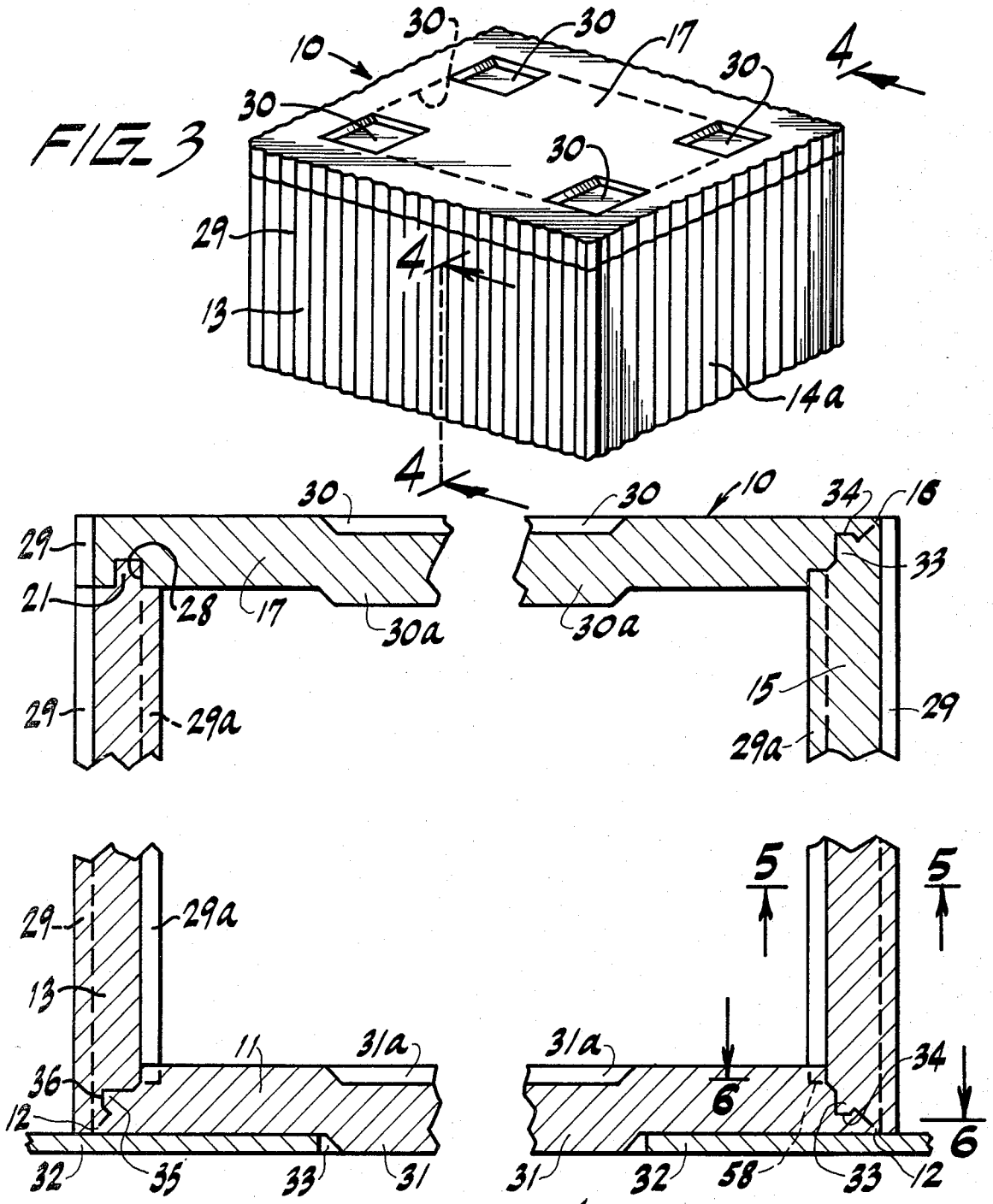
FIG. 4 is a fragmentary sectional view substantially on the broken line 4—4 of FIG. 3 omitting background illustration.
Figure 11A:
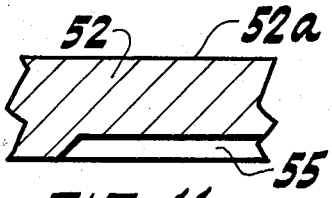
Figure 11B:
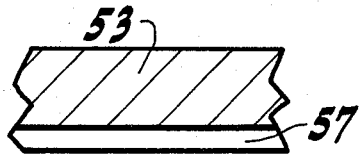
Figure 11C:
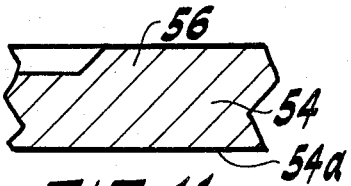

FIGS. 11*a, b,* and *c* are fragmentary sectional views of top, side and bottom panels respectively similar to those in FIG. 4 but illustrating modified detail.

Figure 1:
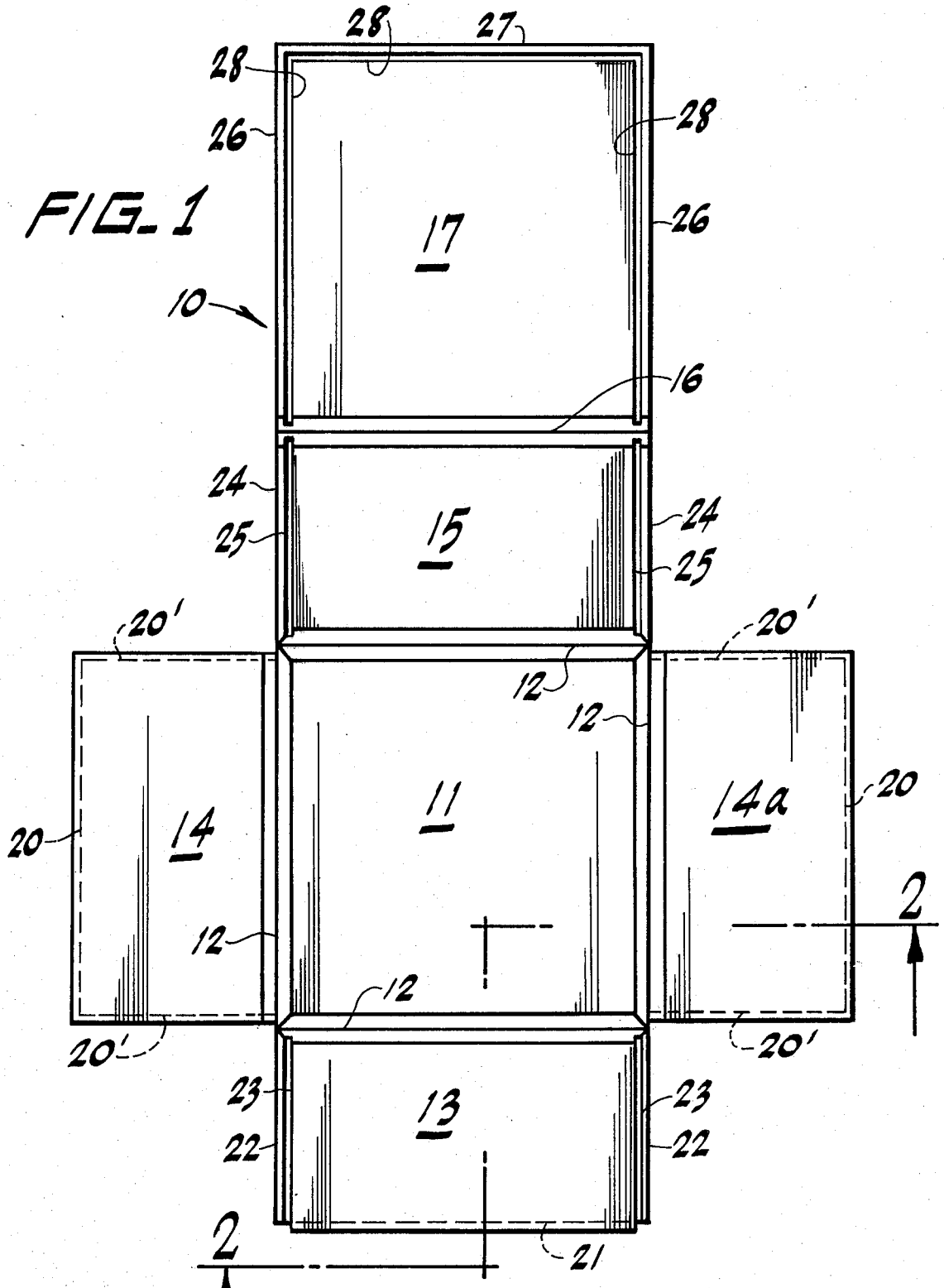
FIG. 1 is a plan view of a typical molded, foamed plastic container in knockdown configuration, to which the improvements of the present invention can be applied.
Figure 2:
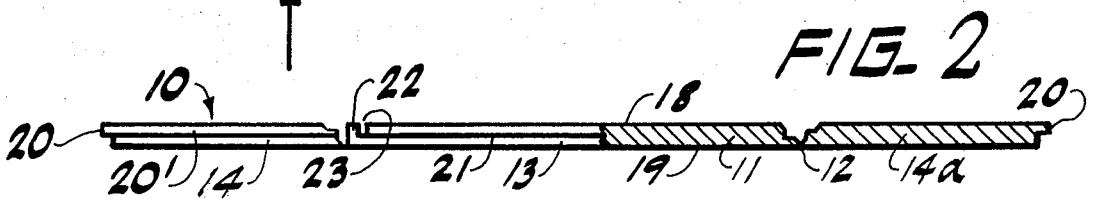
FIG. 2 is a view substantially on the broken line 2—2 of FIG. 1.

As shown in FIGS. 1 and 2 of the drawing containers in accordance with the present invention are molded as a unitary blank 10 providing the six connected panels of a readily assembled container. A bottom panel 11 is joined through molded hinges 12 to a front panel 13, similar side panels 14, 14*a* and rear panel 15 which is joined through another molded hinge 16 to top panel 17. As seen in FIG. 2 the several panels which are of substantial but uniform thickness provide, in the extended position shown, substantially parallel top and bottom surfaces 18 and 19 forming respectively inner and outer surfaces of an assembled container. This means that the containers in the extended configuration shown in FIGS. 1 and 2 can be compactly stacked for shipping and storage prior to use.

As clearly seen in FIG. 2 the free edges of side panels 14, 14*a* are provided with projecting flanges 20, 20' which are approximately ½ the thickness of the panels and aligned with the inner surfaces thereof. Front panel 13 is provided at its outer edge with a similar flange 21; and inwardly spaced from opposed side edges 22, it is provided with grooves 23 adapted to receive flanges 20' at the forward edges of side panels 14, 14*a*.

Rear panel 15 is similarly provided, inwardly of side edges 24 thereof, with grooves 25 adapted to receive flanges 20' at the rear edges of side panels 14, 14*a*. The top panel 17 is provided at its three free edges which form side edges 26 and front edge 27 with an inwardly spaced groove 28 adapted to receive flanges 20 and 21 of assembled front panel 13 and side panels 14, 14*a*.

The grooves and flanges as above described preferably have snug frictional engagement facilitating easy assembly of a three-dimensional container from the blank shown in FIGS. 1 and 2. Thus for example, by raising side panels 14, 14*a* to vertical position and then raising front panel 13, engagement of grooves 23 with front flanges 20' readily supports the partially assembled front and side walls while rear wall 15 is raised to engage rear flanges 20' of the side walls. The container as thus far assembled can readily be handled and moved about while desired objects or material are packed therein; and when the top panel 17 is lowered to engage peripheral groove 28 with flanges 20 and 21 of the side and front panels respectively, a very sturdy container assemblage is provided.

As molded from expandable polystyrene foam or other foamed plastic material, containers as above described combine extremely light weight with physical stability, moisture resisting characteristics and thermal insulation which is frequently desirable in storing and shipping the goods of commerce. To the extent thus far presented, however, the description applies to known, commercially available containers which have limited utility, except as incorporated in supplemental packaging, because of their inability to withstand the pressures encountered in the conventional stacking and palleting of containers during bulk shipment and handling of filled containers. The details of construction hereinafter to be discussed relate to improvements which are aimed at decidedly strengthening this desirable type container so that it can be effectively utilized as a sole shipping container, able to withstand the pressure of pallet stacking and tiering without the need for supplemental packaging.

In FIGS. 3 to 11 which illustrate structural details of the present invention, the reference numerals of FIGS. 1 and 2 have been applied to the basic container components i.e. the side panels, top and bottom panels, the hinges and the flange and groove engagement between side panels and top panel.

In the perspective showing of FIG. 3 the surface area of the side walls has been substantially increased by vertically arranged corrugations 29 shown on front panel 13, side panel 14*a* and peripherally of the edges of top panel 17. The top panel 17 is further provided with depressed means 30 interfitting with protruding means 31 in bottom panel 11, as shown in FIG. 4, for facilitating the aligned stacking of containers 10. As shown in FIG. 3 there are 4 depressed means 30 in the corners of top panel 17 but it is to be understood that top panel 17 can have a single depression indicated by the dotted outline 30, in which event the protruding means 31 on bottom panel 11 would be a single protruding means of comparable size.

Figure 5:
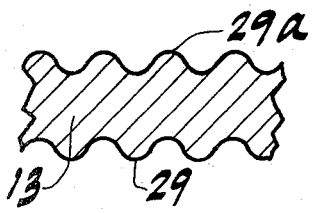
FIG. 5 is a sectional view substantially on the line 5—5 of FIG. 4.
Figure 6:
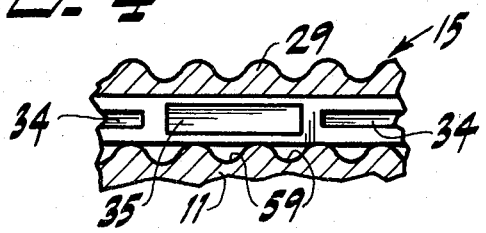
FIG. 6 is a view, partially in section, taken substantially on the broken line 6—6 of FIG. 4.

As more fully illustrated in FIGS. 4 to 6 the fashioning of side wall corrugations 29 and the depressed means 30 and protruding means 31 in the top and bottom panels has been handled in a way to preserve stackability of the container 10 when in the extended or knockdown configuration shown in FIG. 1. This is accomplished through maintaining a uniformity in panel thickness by providing inner surface irregularities which match and interfit with the outer surface irregularities. Thus for example as shown in the sectional view, FIG. 5, the outer corrugations 29 can interfit with the inner staggered corrugations 29*a*. Similarly on top panel 17 the depressed means 30 can be aligned with interfitting protruding means 30*a* on the inner surface and the bottom panel 11 can be provided, in alignment with the protruding means 31 on its outer surface, with interfitting depressed means 31*a* on the inner surface.

Preserving the stackability in knockdown configuration is viewed as of primary importance as it so greatly facilitates the bulk shipment and handling of containers while permitting quick and easy assembly to 3-dimensional form at the point of use.

The side walls of the assembled container have been substantially strengthened by the increase in surface area provided by outer corrugations 29 and inner corrugations 29*a;* and the interfitting depressed means 30 and protruding means 31 complement this strengthening effect by assuring accurate alignment of the side walls of stacked containers. It should be noted in this connection that the orientation of the depressed means 30 and the protruding means 31 could be reversed from that shown in FIG. 4 i.e. the depressed means could be in bottom panel 11 and the protruding means in top panel 17. The selection of orientation most appropriate for a particular container will depend in part on the size, the nature and weight of intended contents, and the type of stacking and palleting practice contemplated for the filled containers. By providing protruding means 31 in bottom panel 11 one achieves a legged or pedestal effect facilitating easy lifting of individual containers. This, at the same time introduces a possible weakness in the lowermost of a stacked pile of containers. Thus, it is desirable when palleting containers of the structure shown in FIG. 4 to provide on the pallette a template 32 of appropriate thickness having cutouts 33 to receive protruding means 31 to provide essentially uniform bearing against the pallet by the stack of containers. On the other hand if the orientation of protruding means 31 and depressed means 30 is reversed so that protruding means 31 will be at the top of a pile of stacked containers, it would be desirable to place a template 32 on top of the stacked containers to equalize the bearing load of a next higher palleted stack of containers.

A further strengthening of the container 10 as shown in FIG. 4 is provided by the interlock at hinge joints 12 between bottom panel 11 and sidewall panels 13, 15 and at the hinge joint 16 between back panel 15 and top panel 17. As shown at the right side of FIG. 4 this interlock is between a vertically oriented projection 33 on the wall panel side of the hinge and a mating depression 34 in the top or bottom panel hinge portions; and it serves to prevent a spreading movement of the wall panels as compression force is applied to the container through stacking.

Another type interlock as shown at the lower left portion of FIG. 4 involves a horizontal projection 35 on the hinge portion of bottom panel 11 and a mating depression 36 in the hinge portion of wall panel 13. This type of interlock is particularly desirable in taller containers intended to package heavy objects. Either type of interlock can extend the full length of a hinge joint, or can be discontinuous to provide a series of spaced projections and mating depressions.

In a preferred adaptation of the reinforced hinge the orientation of the projections and mating depressions may alternate at spaced intervals along a hinge joint as indicated in FIG. 6, where, on the hinge portion of bottom panel 11, a projection 35 has been shown between spaced depressions 34.

Figure 7:
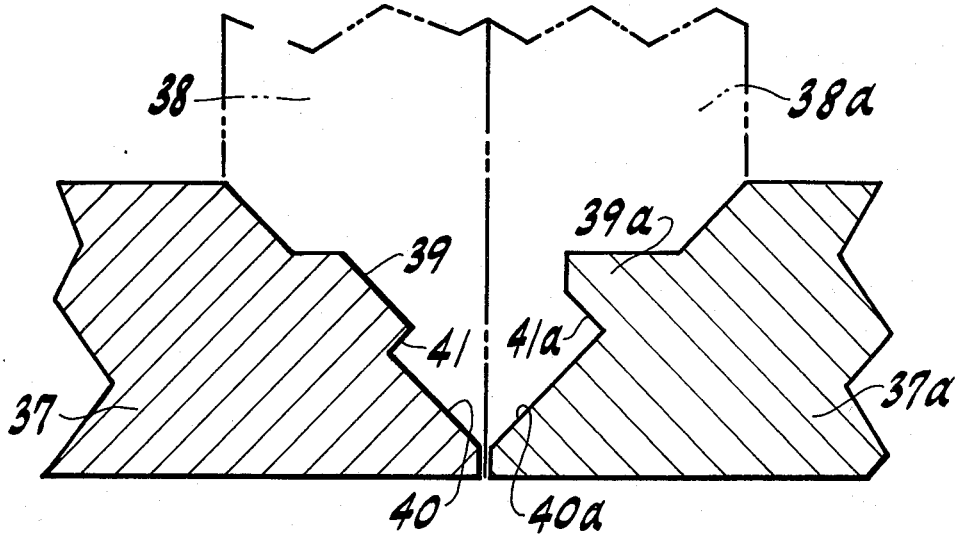
FIG. 7 is an enlarged composite view illustrating hinge interlock details.

Details of the hinge joint interlock means will be more fully understood from a consideration of composite FIG. 7 which shows in full and sectioned lines enlarged hinge panel portions 37, 37*a* oriented as they might be molded, with the dot-dash outlines 38, 38*a* representing either mating panel portions or parts of a forming mold. On panel portion 37 a relatively flat projection 39 extends only a short distance from hinge face 40 and the lower edge 41 thereof which is approximately perpendicular to hinge face 40 is formed by a shallow undercut in mold part 38. When molding material such as foamed plastic, providing some local yieldability in the molded part, fashioning a shallow projection such as shown at 38 does not interfere with stripping the forming mold from the molded part.

Panel portion 37*a* has been shown with a substantially longer projection 39*a* extending from hinge face 40*a*. Here the lower edge 41*a* must be formed by a mold undercut too deep to permit stripping the molded item from a fixed mold part. It is well known, however, in the molding arts to provide slidably, hingedly or otherwise moveable mold parts to provide deep undercuts in the molded article; and the fashioning of projections such as 39*a* with its deeply undercut face 41*a* presents no problem to the mold maker.

The internal finishing of the improved and strengthened container can be widely varied to provide for compartment formation, article support and the like. Depending upon the contents of the item(s) being packaged, the shape and location of the inner projections 30*a* and/or depression 31*a* as shown in FIG. 4 can provide an article positioning means. Further possibilities are shown in FIGS. 8 to 10, however, where a sidewall panel 42 has corrugation 43 on only the outer surface thereof, and the inner surface is provided with vertically oriented grooves 44 for the location of partitioning means or for the sliding engagement of an article to be vertically oriented in the container.

Sidewall panel 42 is associated through hinge joint 45, having interlocking projections 46 and recesses 47, with bottom panel 48, the inner surface of which may be provided with grooves 49, suitably aligned with sidewall grooves 44, to receive partitioning means, and/or with article positioning recesses 50. If desired the article positioning recesses 50 can be provided with undercut portions 51, possibly fashioned by moveable mold parts, for providing interlock with the article(s) being packaged.

Figure 8:
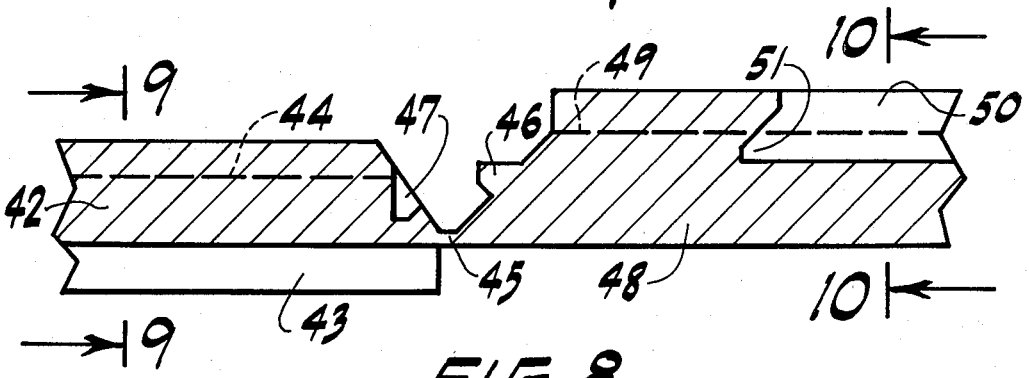
FIG. 8 is a fragmentary sectional view through portions of a side panel and bottom panel in extended or knocked down orientation and illustrating details of inner facing construction.
Figure 9:
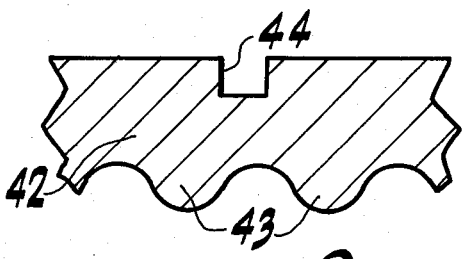
FIG. 9 is a sectional view substantially on the line 9—9 of FIG. 8.
Figure 10:
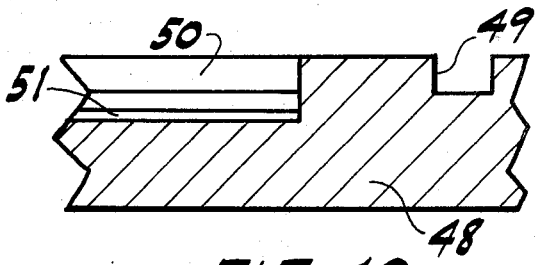
FIG. 10 is a sectional view substantially on the line 10—10 of FIG. 8.

The somewhat thicker wall structures shown in FIGS. 8 to 10 and in an associated top panel, not shown, having vertical positioning recesses similar to recess 50, does not interfere with the compact stacking which is so desirable in the extended or knockdown configuration, as uniformity in effective thickness of the several panel members is preserved.

In some situations the corrugated outer surface of the container may be objectionable, as, for example, when individual packed containers are to be shipped through the mail. In such event the corrugations can be applied only to the inner surfaces of the sidewall panels. With this form of construction a less compact stacking is possible in the knockdown configuration than is possible with the double faced corrugation shown in FIGS. 4 to 6. Furthermore the contiguous top and bottom panels must be similarly increased in thickness to provide flat supported knockdown stacking. One way of accomplishing this has been shown in FIGS. 11*a, b* and *c.* where the overall panel thickness is the same for bottom panel 52, side panels 53 and top panel 54. While the recessed means 55 of bottom panel 52 has no corresponding projection on the upper surface 52*a* it mates with projecting means 56 on top panel 54 which in turn has no recessed means on the under surface 54*a* thereof.

When a sidewall panel 53 having internal corrugations 57 meets a top or bottom wall panel the preferable type of interfit, as shown in FIGS. 4 and 6, involves the formation of horizontal bearing surfaces 58 at ends of the corrugations, interfitting with recesses 59 of corrugation profile in the top and/or bottom panel. This takes maximum advantage of the increase in compression strength provided in the sidewalls by the corrugations.

It will be apparent that for a particular size container the needs for different internal finishing could be almost as extensive as the customers list for that size container. In order to minimize mold costs in meeting these needs it is contemplated that the basic, inner surface mold will be of "modular" construction, with recessed areas in each of the panel forming areas for detachably receiving inserts, and combinations of inserts appropriate for the particular inner finish desired. Similarly the outer surface mold may be of modular construction, having recesses, particularly in top and side panel sections, in which interchangeable inserts can provide the particular symbolic and/or text material desired.

Various changes and modifications in the improved packing and shipping container as herein disclosed may occur to those skilled in the art, and to the extent that such changes and modifications are embraced by the appended claims, it is to be understood that they constitute part of the present invention.

I claim:

1. A packing and shipping container comprising a unitary blank of molded, foamed plastic material in which a bottom panel is hingedly joined to four peripheral side panels and a top panel is hingedly joined to one of said side panels in a manner to provide an essentially co-planar and stackable association of panels when in knockdown configuration, with edges of said side panels and top panel having interlocking means as the side panels are raised to positions perpendicular to the bottom panel, and as the top panel is lowered over the assembled side panels, and in which compressive strength of the assembled container is enhanced by at least one of the structural features that comprise enlarging surface area of the side panels to increase their strength, providing interlocking means at the hinged juncture between adjacent panels, and providing interlocking means on top and bottom container surfaces to assure accurate side wall alignment of stacked containers.

2. A packing and shipping container as defined in claim 1, wherein enlarging of the surface area of the side panels is provided by vertically oriented corrugation on at least one surface of said side panels.

3. A packing and shipping container as defined in claim 1, wherein enlarging of the surface area of the side panels is provided by vertically oriented corrugation on at least the outer surface of said side panels and corresponding and aligning corrugations in peripheral edges of said top panel.

4. A packing and shipping container as defined in claim 3, wherein the surface areas of said side panels are further increased by providing matching corrugations on inner surfaces of said side panels so positioned and proportioned as to permit nested stacking of the container when in knockdown configuration.

5. A packing and shipping container as defined in claim 1, wherein the interlock at hinge joints is provided by vertically oriented recesses in hinge portions of the top and bottom panels and projections from hinge portions of the side panels parallel to the planes thereof and adapted to enter said recesses.

6. A packing and shipping container as defined in claim 5, wherein said recesses and projections are of shallow dimensions, and said projections can be fashioned by fixed undercuts in the forming mold.

7. A packing and shipping container as defined in claim 5, wherein said recesses and projections are of such dimension that said projections form undercuts which must be fashioned by moveable parts of the forming mold.

8. A packing and shipping container as defined in claim 1, wherein the means for assuring side wall alignment of stacked containers comprises interfitting vertically offset means on outer surfaces of the top and bottom panels of the container.

9. A packing and shipping container as defined in claim 8, wherein the vertical offsets in the top and bottom panels carry through the full thickness of said panels to provide nested stacking of containers when in the knockdown configuration.

10. A packing and shipping container as defined in claim 8, wherein a plurality of vertically offset portions provide such vertical offset adjacent corner portions of the top and bottom panels.

11. A packing and shipping container as defined in claim 8, wherein said vertically offset portions extend throughout the major portion of the area of said top and bottom panels.

12. A packing and shipping container comprising a unitary blank of molded, foamed plastic material in which a bottom panel is hingedly joined to four peripheral side panels and a top panel is hingedly joined to one of said side panels in a manner to provide an essentially co-planar and stackable association of panels when in knockdown configuration, with edges of said side panels and top panel having interlocking means as the side panels are raised to positions perpendicular to the bottom panel, and as the top panel is lowered over the assembled side panels, and in which compressive strength of the assembled container is enhanced by providing ribs or corrugations extending vertically of at least one surface of said side panels, and corresponding and aligning ribs or corrugations in peripheral edges of said top panel when ribs are in outer surfaces of said side panels, and means is provided for maintaining knockdown stackability in spite of said added ribs or corrugation.

13. A packing and shipping container as defined in claim 12, wherein said last named means comprises grooves or corrugations on inner surfaces of said side panels interfitting with said ribs or corrugations on the outer surfaces thereof.

14. A packing and shipping container as defined in claim 12, wherein said last named means comprises increasing thickness of said top and bottom panels to equal the increase in thickness dimension of said side panels due to said ribs or corrugation.

15. A packing and shipping container as defined in claim 14, wherein inner surfaces of said bottom and/or top panels contain depressions serving to transversely position items packed in said container.

16. A packing and shipping container as defined in claim 15, wherein at least some of said depressions have peripheral undercut portions providing interlock with said positioned items.

17. A packing and shipping container comprising a unitary blank of molded, foamed plastic material in which a bottom panel is hingedly joined to four peripheral side panels and a top panel is hingedly joined to one of said side panels in a manner to provide an essentially co-planar and stackable association of panels when in knockdown configuration, with edges of said side panels and top panel having interlocking means as the side panels are raised to positions perpendicular to the bottom panel, and as the top panel is lowered over the assembled side panels, and in which compressive strength of the assembled container is enhanced by providing interlocking engagement at said hinged joining of panels, said interlocking engagement resisting transverse outward movement of the side panels as downward pressure is applied to the assembled container.

18. A packing and shipping container as defined in claim 17, wherein said interlocking engagement is provided by projections on hinge portions of said side panels extending in a direction generally parallel to the plane of said side panels cooperating with vertically oriented recesses in hinge portions of said top and bottom panels.

19. A packing and shipping container as defined in claim 18, wherein said projections and recesses are of shallow dimensions, and said projections can be fashioned by fixed undercuts in the forming mold.

20. A packing and shipping container as defined in claim 18, wherein said projections and recesses are of such dimension that said projections form undercuts which must be fashioned by moveable parts of the forming mold.

21. A packing and shipping container as defined in claim 18, wherein said projections and cooperating recesses are spaced logitudinally of a hinge joint.

22. A packing and shipping container as defined in claim 18, wherein said projections and cooperating recesses are spaced longitudinally of a hinge joint, and said joint is further strengthened by interspaced projections on hinge portions of said top and bottom panels entering recesses in hinge portions of said side panels.

23. A packing and shipping container comprising a unitary blank of molded, foamed plastic material in which a bottom panel is hingedly joined to four peripheral side panels and a top panel is hingedly joined to one of said side panels in a manner to provide an essentially co-planar and stackable association of panels when in knockdown configuration, with edges of said side panels and top panel having interlocking means as the side panels are raised to positions perpendicular to the bottom panel, and as the top panel is lowered over the assembled side panels, and in which compressive strength of the assembled container is enhanced by providing vertical ribs or corrugations on inner surfaces of the side panels, providing interlocking means at the hinged juncture between adjacent panels, and providing interlocking means on top and bottom container surfaces to assure accurate sidewall alignment of stacked containers, while maintaining uniform effective thickness in the top, bottom and sidewall panels to preserve the knockdown stackability.

24. A packing and shipping container as defined in claim 1, wherein the inner surfaces of said bottom and/or top panels contain depressions serving to transversely position items packed in said container.

25. A packing and shipping container as defined in claim 24, wherein at least some of said depressions have peripheral undercut portions providing interlock with said positioned items.

26. A packing and shipping container as defined in claim 24, wherein said depressions carry through the full thickness of said panels providing aligned projections on outer surfaces of said panels, and adapted to preserve nested stacking of containers in the knockdown configuration.

* * * * *